US005913406A

United States Patent [19]

Lofgren et al.

[11] Patent Number: 5,913,406

[45] Date of Patent: Jun. 22, 1999

[54] SURGICAL COAT

[75] Inventors: Kristina Lofgren, Molnlycke; Tomas Billgren, Kullavik, both of Sweden

[73] Assignee: Molnlycke Health Care AB, Gothenburg, Sweden

[21] Appl. No.: 08/894,530

[22] PCT Filed: Feb. 20, 1996

[86] PCT No.: PCT/SE96/00222

§ 371 Date: Sep. 18, 1997

§ 102(e) Date: Sep. 18, 1997

[87] PCT Pub. No.: WO96/25863

PCT Pub. Date: Aug. 29, 1996

[30] Foreign Application Priority Data

Feb. 21, 1995 [SE] Sweden ..... 9500638

[51] Int. Cl.[6] ..... A41D 13/12

[52] U.S. Cl. ..... 2/51; 2/93; 2/85

[58] Field of Search ..... 2/51, 93, 97, 85, 2/87, 114, 115, 272, 82, 243.1, DIG. 1

[56] References Cited

U.S. PATENT DOCUMENTS

| | | | |
|---|---|---|---|
| 2,884,639 | 5/1959 | Klepper | 2/97 |
| 2,897,508 | 8/1959 | Bashore | 2/93 |
| 3,219,514 | 11/1965 | Struycken De Roysancour | 2/97 |
| 3,706,102 | 12/1972 | Grenier | 2/97 |
| 3,771,170 | 11/1973 | Leon | 2/97 |
| 4,685,155 | 8/1987 | Fingerhut et al. | 2/87 |
| 4,739,522 | 4/1988 | Lassiter et al. | 2/97 |
| 4,810,559 | 3/1989 | Fortier et al. | 2/51 |
| 5,014,358 | 5/1991 | Matumori | 2/93 |
| 5,150,476 | 9/1992 | Statham et al. | 2/97 |
| 5,155,867 | 10/1992 | Norvell | 2/114 |
| 5,381,558 | 1/1995 | Lo | 2/115 |
| 5,673,433 | 10/1997 | Rothrum | 2/46 |
| 5,794,266 | 8/1998 | Han | 2/159 |

FOREIGN PATENT DOCUMENTS

| | | |
|---|---|---|
| 0 410 438 | 1/1991 | European Pat. Off. . |
| 1 465 122 | 2/1977 | United Kingdom . |

*Primary Examiner*—Amy B. Vanatta
*Attorney, Agent, or Firm*—Young & Thompson

[57] ABSTRACT

The present invention relates to a plastic surgical coat. According to the invention, the coat is comprised at least partially of a plastic material having a pattern of projections which extend out from the inside of the coat to facilitate air circulation through a space between an interior surface of the coat and the body of the wearer.

14 Claims, 1 Drawing Sheet

SURGICAL COAT

The present invention relates to a surgical coat made of plastic material.

In addition to having a liquid-blocking and bacterial-blocking function, a surgical coat shall also be comfortable to wear. To this end, surgical coats are often made of air-permeable and/or vapour-permeable material, such as textile material or nonwoven material which while providing a comfortable coat do not always provide effective protection. In order to enhance protection in this regard, coats and aprons of this kind are sometimes coated completely or partially with a plastic layer, which diminishes comfort to a corresponding degree.

The present invention aims at providing at low cost a surgical coat which has better barrier properties with regard to the blocking of liquid, fluid and bacteria, than surgical coats that are made of textile material, while still providing much better comfort than coats that are coated with plastic layers.

The aim of the invention is achieved with a surgical coat which is characterized in that it is comprised at least partially of plastic material that has been provided with a pattern of projections that extend out from the inside of the coat. Because the surgical coat includes a plastic layer which provides a highly effective liquid and bacteria barrier, the coat will provides the wearer with effective protection. Furthermore, the projections on the inside of the coat greatly reduce the surface area of the coat that is in contact with the wearer's skin, while, at the same time, distancing from the wearer most of the material on which the projections are provided, so as to define between coat and wearer a space in which air can circulate freely. The projections also eliminate the risk of plastic material sticking to the wearer's skin.

In a preferred embodiment of the invention, at least the sleeves of the coat are made of material on which projections have been provided. In a preferred variant of the invention, the entire coat is made of material that has been provided with projections. In one alternative embodiment, absorbent material is fastened to the outside of the coat, at least on parts thereof. The plastic material may also include patterns of projections which project outwardly from the outside thereof, and the coat material has a sinusoidal shape in cross-section, both longitudinally and transversely, wherein the projections have a size such that light which falls onto the coat will be reflected essentially by diffuse reflection. The surgical coat may, for instance, be made of low density polyethylene (LLD).

Figure 1:
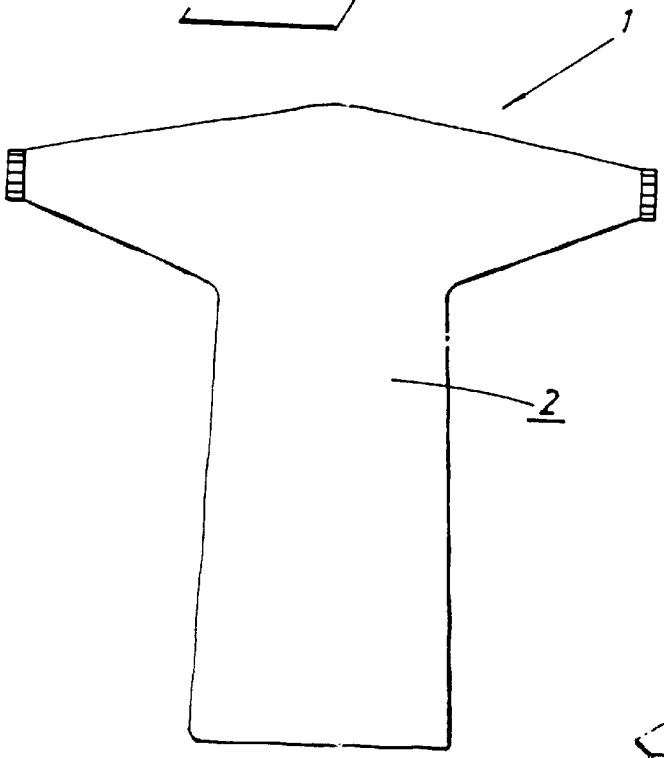
Figure 2:
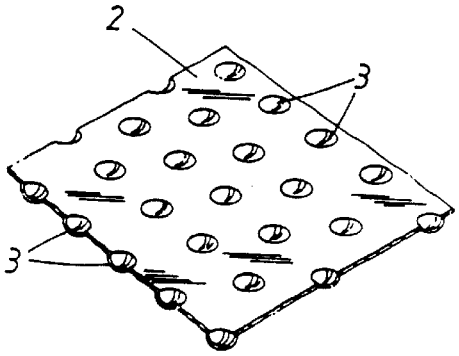
Figure 3:
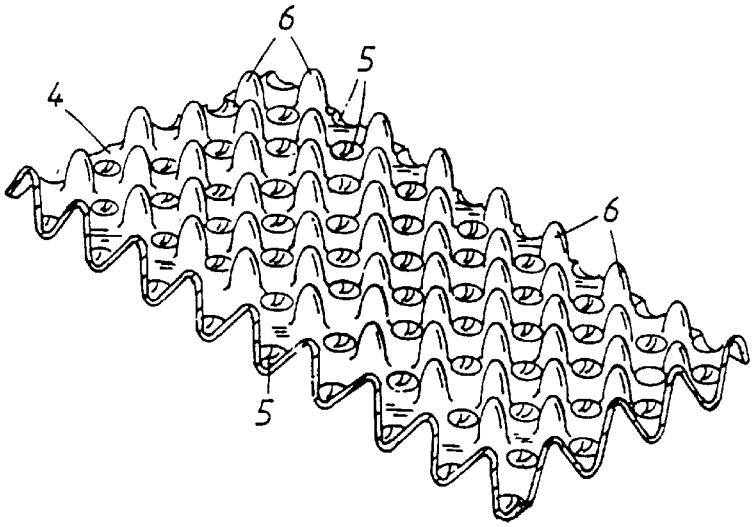

The invention will now be described in more detail with reference to the accompanying drawings, in which FIG. 1 is a schematic front view of a surgical coat according to one embodiment of the invention;

FIG. 2 is a schematic perspective view of a piece of material in the coat shown in FIG. 1; and FIG. 3 is a schematic perspective view of a piece of material of a different embodiment suitable for use in an inventive surgical coat.

The surgical coat 1 illustrated in FIG. 1 is made of a plastic material 2, for instance linear low-density polyethylene (LLD), having a thickness of 20–200 $\mu$m. The plastic material 2 is provided with a pattern of cup-shaped projections 3 which project out inwardly from the inner surface of the coat material, i.e. the surface which will lie proximal to the wearer. The major part of the coat material will therefore be distanced from the wearer's body, since only the apices or tips of the projections will lie against the wearer. Those regions of the coat material that lie directly against the wearer's skin, e.g. against the arms of the wearer, will generate only a small degree of friction against the skin, at the same time as the space between the planar parts of the coat material and the wearer's skin enables air to circulate freely between the projections. The projections also eliminate the risk of coat material sticking to the skin, this risk being much greater when the coat is made of smooth plastic material. The inventive surgical coat is therefore more comfortable to wear than conventional coats that have a corresponding protective effect.

In order to further enhance wearing comfort, those parts of the coat which do not need to be impervious to liquid, for instance the back of the coat or beneath the coat sleeves, may be perforated to facilitate air circulation. The coat may alternatively be made of vapour-permeable/air-permeable plastic, so-called breathable plastic. Because the projections increase the specific surface area of the coat material in comparison with planar material, the vapour-permeability of a coat made of breathable plastic in accordance with the invention will be greater per unit of surface area than if the coat were to be manufactured from planar material.

The inventive coat can also be produced and provided with tight joins more easily than a coat made of textile material, since the joins can be produced by heat-welding or ultrasonic welding.

Although the projections 3 of the illustrated exemplifying embodiment have a cupped shape, it will be understood that the projections may have other shapes, such as cubic shapes, pyramidal shapes, hemispherical shapes and ball-shapes. Forms with rounded tops are preferred in order to obtain the smallest possible abutment surface. In order to provide the comfort required, the projections will preferably have a height of between 0.2–3 mm, and their diameter will preferably lie between 0.2–3 mm. The distance between mutually adjacent projections in the pattern will preferably not be greater than 5 mm.

FIG. 3 illustrates a piece of plastic material 4 that can be used conveniently in an inventive surgical coat. This material differs from the material 2 shown in FIG. 2 by virtue of also including outwardly projecting projections 6 in addition to the inwardly projecting projections 5. As will be seen from FIG. 3, longitudinal and transversal cross-sections through the tops of the projections have sinusoidal shapes. The proportion of planar surfaces per unit of surface area of the material is very small in the case of this material. Consequently, the major part of light that falls on such material will be reflected diffusely, which is an advantage in operating theatres that are illuminated with bright light. Furthermore, the diffuse reflection will impart to the material less of a plastic appearance, which is normally experienced as positive by the wearer and therewith enhances the feeling of comfort when wearing the coat. The material illustrated in FIG. 2 provided solely with inwardly projecting projections will, of course, also reduce the amount of light that is reflected directly, although to a much lesser degree.

It will be understood that the described and illustrated embodiment can be modified within the scope of the invention. For instance, the material which includes the projections may be arranged solely in the sleeves and/or the neck part of the coat. Furthermore, absorbent material, such as nonwoven fabric, may be attached to the coat on exposed areas thereof, for instance in the waist region of the coat and the sleeves, such as to prevent blood or other fluid that splashes onto the coat from running along the coat and down onto the floor. The plastic material may alternatively comprise a laminate of, e.g., plastic-nonwoven material. The invention is therefore limited solely by the contents of the following Claims.

We claim:

1. In a surgical coat comprising a front part, a back part, two sleeves and a neck part, said coat being arranged and adapted to facilitate air circulation through a space between an interior surface of the coat and a body of a wearer when in use, the improvement wherein said coat is made of a plastic material having a thickness of 20–200 $\mu$m, wherein the plastic material has, at least in the sleeves and in the neck part of the coat, a pattern of projections which extend out from the interior surface of the coat to define said space through which air circulates.

2. The surgical coat of claim 1, wherein the projections extend out from the interior surface of an entirety of the coat.

3. The surgical coat of claim 2, wherein the plastic material also includes a pattern of further projections which extend out from a side of the coat which in use will lie distal to the wearer.

4. The surgical coat of claim 3, wherein the plastic material has a sinusoidal cross-sectional shape both longitudinally and transversely; the size of the projections being such that light falling on the coat will be reflected essentially by diffuse reflection.

5. The surgical coat of claim 1, wherein the plastic material is a linear low-density polyethylene.

6. The surgical coat of claim 1, wherein the plastic material is a breathable plastic film material.

7. In a surgical coat comprising a front part, a back part, two sleeves and a neck part, said coat being arranged and adapted to facilitate air circulation through a space between an interior surface of the coat and a body of a wearer when in use, the improvement wherein said coat is made of a plastic material, wherein the plastic material has, at least in the sleeves and in the neck part of the coat, a pattern of projections which extend out from the interior surface of the coat to define said space through which air circulates, and wherein an absorbent material is attached to at least parts of the plastic material on the side thereof which in use will lie distal to the wearer.

8. The surgical coat of claim 7, wherein the projections extend out from the interior surface of an entirety of the coat.

9. The surgical coat of claim 8, wherein the plastic material also includes a pattern of further projections which extend out from a side of the coat which in use will lie distal to the wearer.

10. The surgical coat of claim 9, wherein the plastic material has a sinusoidal cross-sectional shape both longitudinally and transversely; the size of the projections being such that light falling on the coat will be reflected essentially by diffuse reflection.

11. The surgical coat of claim 7, wherein the plastic material is a linear low-density polyethylene.

12. The surgical coat of claim 7, wherein the plastic material is a breathable plastic film material.

13. A surgical coat comprising a plastic material having plural projections which extend out from an exterior surface of the plastic material and plural further projections which extend out from an interior surface of the plastic material so that said plastic material has a sinusoidal cross-sectional shape both longitudinally and transversely, said further projections defining a space between the interior surface of the plastic material and a wearer's body through which air circulates when in use.

14. The coat of claim 13, wherein said coat comprises a front part, a back part, two sleeves, and a neck part, and wherein said projections are in at least said sleeves and neck part.

* * * * *